United States Patent [19]

Shinno

[11] 4,327,132

[45] Apr. 27, 1982

[54] METHOD FOR LINING OF INNER SURFACE OF A PIPE

[76] Inventor: Kiyonori Shinno, 67-7, Shimaizumi 8-chome, Habikino City, Osaka, Japan

[21] Appl. No.: 240,703

[22] Filed: Mar. 5, 1981

Related U.S. Application Data

[63] Continuation of Ser. No. 80,719, Oct. 1, 1979, abandoned.

[51] Int. Cl.[3] ..... B05D 1/02; B05D 7/22

[52] U.S. Cl. ..... 427/235; 118/317; 118/DIG. 10; 427/236; 427/421

[58] Field of Search ..... 427/235, 233, 236, 421, 427/426; 118/317, 318, DIG. 10

[56] References Cited

U.S. PATENT DOCUMENTS

| | | | |
|---|---|---|---|
| 1,146,791 | 7/1915 | Greenfield | 427/386 |
| 1,758,810 | 5/1930 | Austin et al. | 427/386 |
| 2,331,824 | 10/1943 | Buckingham | 138/145 |
| 3,974,306 | 8/1976 | Inamura et al. | 427/183 |
| 3,982,050 | 9/1976 | Kato et al. | 427/181 |
| 4,057,664 | 11/1977 | Audykowski | 427/386 |

FOREIGN PATENT DOCUMENTS

| | | | |
|---|---|---|---|
| 47-29771 | 8/1972 | Japan . | |
| 1186678 | 4/1970 | United Kingdom | 427/236 |
| 413999 | 6/1974 | U.S.S.R. | 427/233 |

*Primary Examiner*—Shrive P. Beck

*Attorney, Agent, or Firm*—Griffin, Branigan & Butler

[57] ABSTRACT

Water mains, water pipes of housing-development apartments or water pipes of factories can be lined by this method. At first epoxy resin solutions A and B are mixed. The epoxy resin paint is atomized by a rapid air stream. The gaseous mixture is still accelerated by another air stream and blown into a pipe to be lined. The mixture fluid adheres to the inner surface of the pipe and forms a lining layer from the inlet to the outlet of the pipe in succession. When the lining process finishes, the supply of epoxy resin paint is stopped but the air is still blown in to dry the paint quickly for a short time. The residual paint exhausted from the outlet is withdrawn and revived to liquid. This method is useful for the pipes with a diameter larger than $\frac{1}{4}$ inch.

4 Claims, 1 Drawing Figure

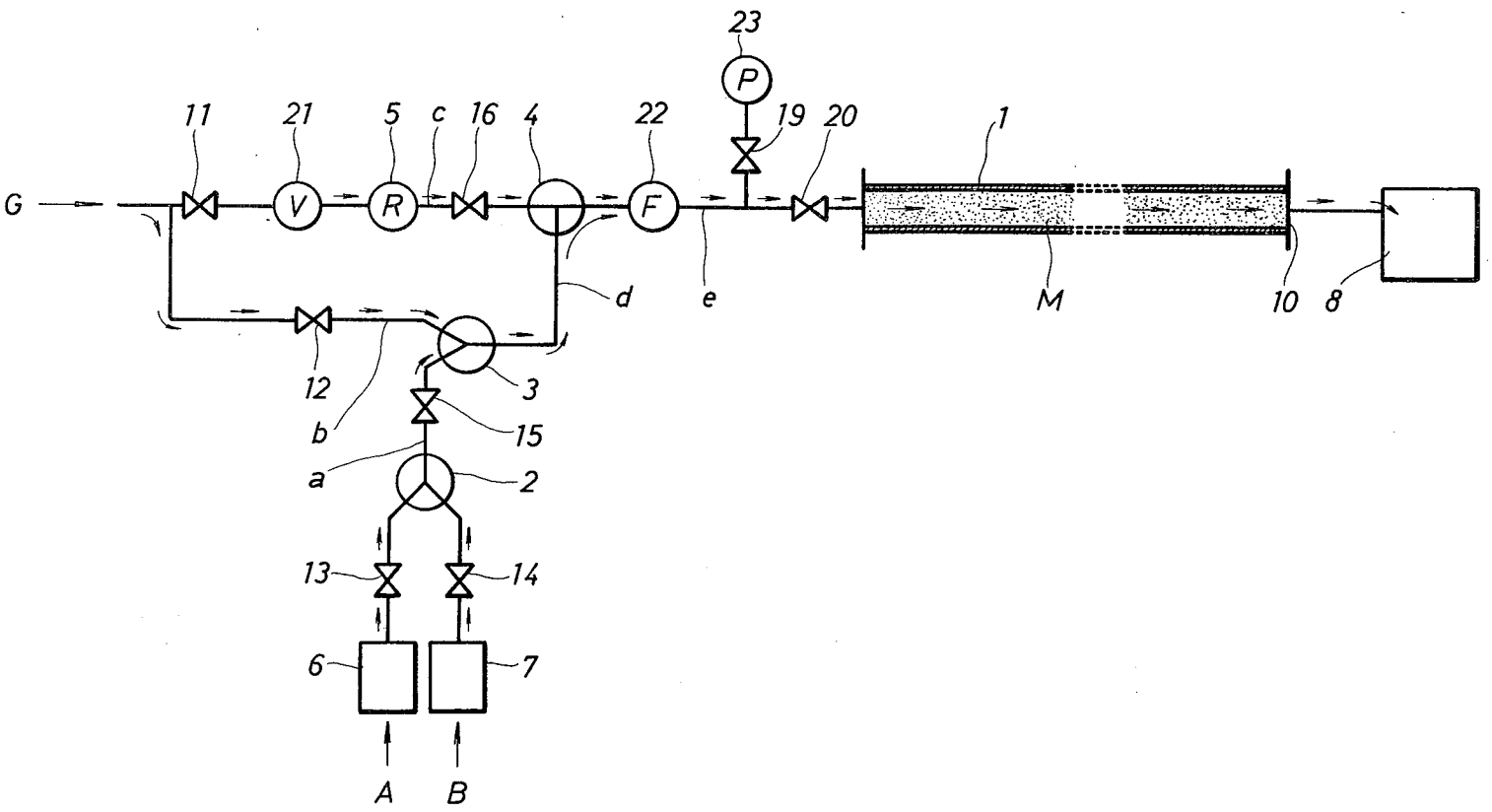
G
11
21
V
5
R
c
16
4
22
F
23
P
19
20
1
M
10
8
d
e
12
b
a
3
15
2
13
14
6
7
A
B

METHOD FOR LINING OF INNER SURFACE OF A PIPE

This is a continuation of application Ser. No. 080,719, filed Oct. 1, 1979, now abandoned.

BACKGROUND OF THE INVENTION

This invention relate to a method for lining of inner surface of a pipe by blowing atomized epoxy resin paints into the pipe.

Water mains, water pipes of apartment-houses or water pipes of factories are made from metal pipes, especially from iron pipes in many cases.

Though iron pipes are cheap and tough, they are apt to rust. The rust gradually grows up in the pipe and becomes a big lump (scale) which decreases an effective sectional area of the pipe. On account of rust in the water pipe, city water become muddy and brown. It is inadequate for cooking, drinking or washing.

Some methods of eliminating such scales in pipes are already known.

For example the method of eliminating scales by pushing a shell-formed matter with pressurized water or air in a pipe is well known.

When scales are eliminated perfectly, the inner surface of the pipe is revived to a clean state. However if the pipe were used as it is, it would rust again. Therefore the inner surface of the pipe must be lined with an adequate rustproof paint immediately after eliminating scales.

The customary method for painting inner surfaces of pipes is simply a traditional painting method applied for external surfaces. Namely a painter passes a painting spray coupled with a long hose through a pipe and paints the inner surface thereof by pulling out the hose slowly.

An advantage of this method is that ready-made painting tools can be used. But it has three disadvantages.

Firstly it requires a hose longer than the pipe to be lined. Thus this method is incapable of use for lining a long pipe. Secondly it is available only for pipes with wide diameters because a spray must be passed through the pipes. In practice this method cannot be applied to a narrow pipe with a diameter less than 3 B (1 B means 1 inch). Thirdly this method requires a long time because the hose must be moved slowly in order to avoid irregular painting.

Water mains in housing developments can be painted by the customary method, as the width of water mains is generally 3 B (3 inches). However this method is not available for water pipes of houses because the water pipes are only ½ B (half inch) wide.

Of course newly-produced pipes are lined properly by some methods. A new pipe which is not installed in a city water system can be easily moved, rotated or heated.

One method of painting new tubes or pipes is an electrostatic painting method and the other is a heating adhesion method of plastic tubing.

In the electrostatic painting method, some paint is introduced into the tube which is rotating slowly and charged with electricity. The paint particles adhere by the electrostatic force to the inner surface of the tube.

In the heating adhesion method, a thermoplastic tube—for example of vinyl chloride—with a diameter slightly narrower than that of the iron pipe to be lined, is inserted in to the iron pipe and is heated. By the action of heat the thermoplastic tube adheres to the inner surface of the iron pipe.

Both methods are useful only to new, isolated straight tubes. But pipes which have bends or elbows cannot be lined by these methods, because a thermoplastic tube cannot pass through an iron pipe with bends or elbows, and a non-straight iron pipe cannot be uniformly rotated in a heating device.

Furthermore these methods are totally ineffective to pipes which have been installed in buildings or laid under ground, because these pipes cannot be rotated nor heated and have many bends or elbows.

SUMMARY OF THE INVENTION

This invention solves these difficulties.

The object of the invention is to provide a method for lining the inner surface of a pipe by blowing a mixture gas of air and epoxy resin paint throughout a pipe. Here epoxy resin paint includes both two-solution-type and one-solution type paint. In the case of using two-solution-type paint, this method comprises a mixing process of solutions A and B of epoxy resin paint, an atomizing process to make a mixture fluid of air and paint particles and an accelerating process for blowing the mixture fluid into a pipe to be lined.

If necessary, it is possible to combine the atomizing process and the accelerating process.

The mixture gas passes through the pipe rapidly. Paint particles contact with, and adhere to, the inner surface of the pipe. A thin layer of resin paint is formed on the surface near the inlet of the pipe. The resin paint returns to liquid and flows toward the outlet by the action of the gas stream. The layer of paint develops from the inlet toward the outlet of the pipe gradually. The loss of resin paint in some region of the surface is compensated for by a new adhesion of paint particles therein.

This method is fully novel and may be strange for expert engineers of painting techniques. Perhaps they thought that in a long pipe the mixture gas would naturally be separated to air and paint by the long action of gravity, and that the upper half of the surface would be left blank. Otherwise they might have thought that as the power driving the mixture gas decreases in the long tube, paint material of the gas drops on the surface and forms a big lump of paint which might hinder the flow of mixture gas.

However this inventor thought over these superficial dogmas and found the misunderstandings of expert engineers about the relation of gravity and power of gas flow.

In a closed uniform pipe the velocity of compressible gas flow never decreases but rather increases along the flow line, because the continuation equation requires $$\rho v = \text{constant}$$

where $\rho$ is concentration of gas and v is line velocity. Generally $\rho$ decreases along the flow line, as the pressure of gas decreases. Therefore the power of gas flow does not decline in a closed uniform pipe having an inlet and an outlet at both sides.

Although the friction force between the wall of pipe and the gas flow deprives the gas flow of some amount of energy, the velocity never decreases, because the energy is strictly compensated by a pressure loss of the gas flow.

Bernoulli's equation shows that the energy of fluid consists of pressure energy (P), kinetic energy ($\frac{1}{2}\rho v^2$) and potential energy ($\rho gH$). In a uniform tube along a horizontal line, only pressure energy declines by the friction (or viscosity). On the contrary kinetic energy which determines the power of gas flow increases.

Furthermore as the velocity of gas flow is very large and the Reynold's number is large, turbulent flow occurs in the pipe.

Generally speaking turbulent flow prevents liquid particle from dropping downward. The action of the turbulent flow on small liquid particle is very much larger than that of gravity. The action of gravity is nearly negligible in a rapid gas stream in a pipe. Therefore the inventor thought that in a long pipe the mixture gas would not be separated into air and paint until the gas reaches the outlet of the pipe. And he concluded that the adhesion of paint particles on the inner surface would be symmetrical around the center axis of the pipe, for the action of gravity is negligible to that of turbulent flow.

The inventor has contrived this method for lining of a pipe after the above mentioned considerations opposing against superficial dogmas.

Many experiments have taught the inventor that his considerations are true. By blowing in a mixture gas including paint particles, pipes which have several bends or elbows can be lined uniformly along their lengths symmetrically around center axes of the pipes.

DESCRIPTION OF DRAWINGS

The single FIGURE diagrammatically illustrates the invention for lining the inner surface of a pipe with epoxy resin paint.

DETAILED DESCRIPTION

Numeral 1 is a pipe to be lined, the diameter of which is bigger than $\frac{1}{4}$ B. Here the pipe 1 to be lined denotes an arbitrary installed pipe-water main laid under the ground, water pipe of a housing-development apartment, water pipe of heat exchanger, and so forth.

Of course both ends of the pipe have to be made open preliminarily. In the case of the water pipe of a housing development, a proper joint adjacent to a storage tank on the roof and a water tap in a room are usually detached to open both ends of the pipe to be lined.

The joint epoxy resin mixture is introduced into the pipe and is exhausted out of the water tap. Changing the outlet water taps, an operator goes on painting each room in succession, although the inlet joint is common.

Epoxy resin solution consist of A solution and B solution. A solution is a main material of epoxy resin for painting. B solution is a hardening material acting on A solution. Such a mixture type of epoxy resin paints is well known.

The epoxy resin solutions A and B supplied by definite volume feeders 6 and 7 pass through valves 13 and 14 respectively and become mixed in a mixing apparatus 2 in a certain ratio of mixture. The mixture liquid of epoxy resin passes through a liquid pipe (a) via a valve 15 and goes into a mixing nozzle 3, which atomizes the mixture liquid into a mixture fluid containing small paint particles.

Compressed air is supplied into the equipment, for instance by an air compressor (not shown in the figure). The compressed air is divided into two streams. One stream of the air is supplied to the mixing nozzle 3 through an air pipe (b) via a valve 12. Here the compressed air atomizes the epoxy resin mixture into a mixture fluid of resin particles and air.

The mixture fluid produced in the mixing nozzle 3 enters an accelerating nozzle 4 via a mist pipe (d).

Another stream of compressed air goes into a regulator 5 via a valve 11. The regulator 5 makes the air stream a very rapid flow by choking the stream. The rapid flow of air goes through a main pipe (c) via a valve 16 and enters an accelerating nozzle 4, at which the mist pipe (d) is coupled with the main pipe (c). The accelerating nozzle 4 produces a gaseous jet of mixture fluid of resin particle and air by accelerating the mixture fluid by the rapid air flow.

The jet of mixture fluid makes its way through an introductory pipe (e) via a valve 20 and rushes into a pipe 1 to be lined. As the mixture fluid M is flowing in the pipe 1, paint particles contact with the inner surface of the pipe 1, adhere to it and revive to viscous liquid. The paint liquid flows forward from an inlet to an outlet 10 by the force of the air jet. A paint layer formed on the inner surface gradually grows from the inlet of the pipe to the outlet. Though the paint liquid is constantly carried forward, the loss of liquid at a certain region is compensated by a new adhesion of liquid on it.

Of course, all of the paint blown into the pipe 1 is not totally consumed in the pipe. Some amount of paint resin reaches the outlet 10 as gaseous mixture. A withdrawal device 8 placed at the outlet 10 withdraws residual paint particles and revives it to liquid. In many cases a simple vessel is used as a withdrawal device 8. But when the paint flux is very abundant, a withdrawal device 8 shall consist of a fan and a gas-liquid separator.

If the mixture fluid M is exhausted from the outlet 10, it is possible to accomplish a complete lining from end to end of the pipe. On the contrary if the gas emitted from the outlet 10 contains no paint particle, it means a shortage of mixture liquid of resin paint or a weakness of air jet. In this case the operator adjusts the opening degree of the valves 11–16.

Numerals 21, 22 and 23 denote a velocity meter, a flux meter and a pressure gauge. A valve 19 interconnects the pressure gauge 23 with the introductory pipe (e).

When the lining process is finished, the supply of epoxy resin paint into the pipe 1 is stopped by shutting the valves 12–15. However the valves 11, 16 and 20 are still kept open for a short time in order to dry the painted surface by the cold or hot air stream. Then if necessary, the pipe 1 should be sterilized by blowing the air containing a sterilizer—for example, a dilute hypochlorous acid solution.

By this method comparatively narrow pipes can be lined also. But as narrower pipes are accompanied by larger pressure loss of fluid passing through it, the maximum lengths of pipes which can be lined by this method are restricted is regard to their width.

If the required depth of lining is 0.2–1 mm, the examples of the maximum lengths of the pipes for which this method is available are as follows,

| inner diameter | maximum length |
|---|---|
| 1 B | 50 m |
| 2 B | 100 m |
| 3 B | 150 m |
| 4 B | 200 m |

Other experiments show that optimum range of the flux of mixture fluid are,

| inner diameter | optimum flux |
|---|---|
| 1 B | 1.5~2.5 ($M^3$/min) |
| $1\frac{1}{4}$ B | 2.3~3.9 |
| $1\frac{1}{2}$ B | 3.4~5.6 |
| 2 B | 6~10 |
| 3 B | 13.5~22.5 |
| 4 B | 24~40 |

One advantage of this invention is that narrow pipes can be lined easily. The narrowest limit of pipes for which this method is useful is $\frac{1}{4}$ inch width. This is also available for pipes which have bends or elbows midway, because this method need not pass any rigid material through a pipe. A further advantage of this system is that the method needs neither a long hose nor spray.

Moreover operation time for lining a pipe is very short. It takes only two or three minutes to line a pipe of 10 meter length by this method.

The velocity of the mixture fluid shall be 30–100 m/s. It is easy to form a lining layer with a depth of 0.2–1 mm.

To change the depth of the lining layer, the viscosity of epoxy resin or the velocity of the mixture gas shall be changed. The adequate scope of the viscosity of epoxy resin paint is 2,000–30,000 centipoise.

Concerning temperature of the operation, it is not necessary to heat the epoxy resin under an usual condition. But on a cold day in winter it is better to heat the epoxy resin nearly to 20° C.

In the embodiment two-solution-type of epoxy resin paint is used. Though two-solution-type is the most prevailing epoxy resin, one solution type is also available. In this case the mixing apparatus 2 shall be omitted. And only a single feeder shall be needed to supply the epoxy resin liquid to the mixing nozzle 3.

This embodiment uses two steps of accelerating mechanism—one is the mixing nozzle 3 and the other is the accelerating nozzle 4. But one step mechanism of acceleration is also available. Namely in this case compressed air is not divided into two stream. One stream of air and the resin liquid are mixed and accelerated by a single mixing nozzle.

What I claim is:

1. A method for coating the inner surface of a pipe comprising the steps of:

producing a first gaseous flow and mixing it with small, liquid, coating-material particles to form a first flowing mixture fluid containing gas from said first gaseous flow and said small, liquid coating material particles;

producing a second gaseous flow and mixing said first flowing mixture fluid therewith to produce a second flowing mixture fluid containing gas from said first and second gaseous flows and small coating material particles;

introducing said second flowing mixture fluid into a first end of the pipe to be coated;

wherein is further included the step of controlling the volume of said second gaseous flow independently of controlling the concentration of coating material particles in said first flowing mixture to control the amount of coating material particles exiting from a downstream end of said pipe being coated.

2. A method for coating the inner surface of a pipe as in claim 1 and further including the step of mixing at least two epoxy resin solutions to obtain the coating material.

3. A method for coating the inner surface of a pipe as in claim 1 wherein is further included the step of collecting unused coating material at a second, downstream, end of said pipe to be coated.

4. A method for coating the inner surface of a pipe as in claim 1 wherein is further included the step of drying said coating material deposited on the inner surface of said pipe by said second flowing mixture fluid by ceasing to mix said coating material with said first gaseous flow and thereafter continuing to introduce at least said second gaseous flow into said first end of said pipe to be coated.

* * * * *

UNITED STATES PATENT AND TRADEMARK OFFICE

CERTIFICATE OF CORRECTION

PATENT NO. : 4,327,132

DATED : April 27, 1982

INVENTOR(S) : Kiyonori Shinno

It is certified that error appears in the above—identified patent and that said Letters Patent is hereby corrected as shown below:

Column 1, line 19, change "become" to -- becomes --; line 51, change the first "is" to -- are --. Column 2, line 21, change "solution type" to -- solution-type --; line 67, after "energy", insert -- loss --. Column 3, line 24, after "ing" delete -- against --; line 51, change "solution" to -- solutions --. Column 4, line 57, change "is" to -- in --.

Signed and Sealed this

*Twentieth* Day of *July 1982*

[SEAL]

*Attest:*

GERALD J. MOSSINGHOFF

*Attesting Officer*

*Commissioner of Patents and Trademarks*